US008878087B2

(12) United States Patent
Lee

(10) Patent No.: US 8,878,087 B2
(45) Date of Patent: Nov. 4, 2014

(54) ILLUMINATED RESILIENT PRESSING MEMBER

(71) Applicants: Lite-On Electronics (Guangzhou) Limited, Guangzhou (CN); Lite-On Technology Corporation, Taipei (TW)

(72) Inventor: Chien-Hsin Lee, New Taipei (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 169 days.

(21) Appl. No.: 13/681,597

(22) Filed: Nov. 20, 2012

(65) Prior Publication Data

US 2014/0042005 A1 Feb. 13, 2014

(30) Foreign Application Priority Data

Aug. 9, 2012 (CN) ..... 2012 1 0281013

(51) Int. Cl.
*H01H 9/00* (2006.01)
*H01H 13/83* (2006.01)

(52) U.S. Cl.
CPC ..... *H01H 13/83* (2013.01)
USPC ..... 200/310; 362/23.05

(58) Field of Classification Search
USPC ..... 200/310; 362/23.02, 23.05, 23.07, 362/23.19; 341/22
See application file for complete search history.

(56) References Cited

U.S. PATENT DOCUMENTS

| | | | | |
|---|---|---|---|---|
| 5,747,756 | A * | 5/1998 | Boedecker | 200/5 A |
| 6,670,565 | B2 * | 12/2003 | Hanahara et al. | 200/314 |
| 6,747,402 | B2 * | 6/2004 | Hato et al. | 313/305 |
| 8,207,462 | B2 * | 6/2012 | Tsai | 200/310 |
| 2013/0076542 | A1 * | 3/2013 | Tanaka et al. | 341/22 |
| 2013/0313095 | A1 * | 11/2013 | Lee | 200/5 A |

* cited by examiner

*Primary Examiner* — Vanessa Girardi
(74) *Attorney, Agent, or Firm* — Li & Cai Intellectual Property (USA) Office

(57) ABSTRACT

The instant disclosure is a resilient pressing member structure having a pressing unit disposed on top of a translucent insulated layer, an upper cover, a light-emitting unit, two conductive layers and a spacer. The pressing unit includes a plurality of pressing members while the cover is formed with a cavity filled with a fluid to achieve the effect of pressure dispersion. A light guiding structure and a light reflecting structure are disposed on the topside and the backside of the insulated layer, respectively. The insulated layer is formed by at least one light unit opening which extends through the insulated layer. The light-emitting unit is hosted inside the light unit opening. Light from the light-emitting unit penetrates the insulated layer and reaches the pressing member. Then the guiding structure directs light while the reflecting structure reflects light towards the pressing member, thus illuminates the pressing member.

15 Claims, 5 Drawing Sheets

ILLUMINATED RESILIENT PRESSING MEMBER

BACKGROUND OF THE INVENTION

1. Field of the Invention

The instant disclosure relates to a pressing member structure; in particular, to a resilient pressing member structure which can enhance pressing member identification and convenience under conditions of deficient lighting. Furthermore, the instant disclosure provides a backlight pressing member structure capable of achieving low weight and reduced cost.

2. Description of Related Art

As the design of keyboard becoming more and more diverse in the market, not only is the input function essential to a keyboard, the visual effects of the keys are becoming more and more valued by the end users. As a result, the release of an illuminated keyboard which visually attracts end users' attention hence heightens the chances of sales. On a more practical note, the keyboard illuminates at night as well as environments with inadequate lighting, specifically by illuminating symbols, numbers, and text on the keys, thus improving the user's operating experience with the keyboard.

Although many conventional keyboards which are out in the market are equipped with backlights, the keyboard backlighting effect is achieved by a detached large-ranged light guiding board and film which are commonly used. However, excess cost is also induced with the large-ranged board. Furthermore, due to the light guiding board and film being disposed beneath the electrical signal thin-film layer, light flux in the common backlighting keyboards is dramatically diminished. Consequently, insufficient light is diffused through the keys, and renders poor illumination.

SUMMARY OF THE INVENTION

In order to further the understanding regarding the instant disclosure, the following embodiments are provided along with illustrations to facilitate the disclosure of the present invention.

The instant disclosure of a resilient pressing member structure is possesses both economical and practical values. The resilient pressing member structure does not require the individual large-ranged light guide panel and film to achieve illumination. The light guide panel and film are not disposed below the electrical signal thin-film layer and as a result, the amount of light lost is reduced.

The instant disclosure of the resilient structure comprised of a pressing unit, a upper cover, a translucent insulated layer, at least one light guiding structure, at least one light reflective structure, at least one light-emitting unit, a first conductive layer, a spacer, a second conductive layer, and a base plate.

The pressing unit is disposed on top of the translucent insulated layer, and possesses a plurality of pressing members. Each pressing member has a resilient contact surface and four side faces. Each pressing member is comprised of one resilient contact surface, four side faces, and the insulated layer as portions defining a cavity. The cavity may be filled with one of the following fluids: a gas, and a liquid in order to achieve the effect of cushioning and pressure dissipation. The upper cover overlays on top of the pressing unit while having portions defining at least one pressing member opening which individually encompass and restrain the four side faces of each pressing member. The light guiding structure is disposed on the front side of the translucent insulated layer while the light reflecting structure is disposed on the backside side of the translucent insulated layer. The translucent insulated layer is formed with a light unit opening which extends vertically through the entire translucent insulated layer and also holds the light-emitting unit. The light which radiates from the light emitting unit travels horizontally through the translucent insulated layer and reaches just below the area beneath the pressing member. While the light guiding structure transmits the light onto the pressing member, the light reflecting structure boosts light reflectiveness, and as a result of both light structures, the overall brightness of the pressing members is enhanced.

The first conductive layer is disposed on the backside of the translucent insulated layer. A plurality of first conducting portions is disposed on the backside of the first conductive layer and each upper contact plate individually corresponds to each pressing member. The second conductive layer is disposed below the first conductive layer. A plurality of second conducting portions is disposed on the topside of the second conductive layer and each lower contact plate individually corresponds to each upper contact plate. The spacer is disposed between the first conductive layer and second conductive layer, and has portions defining a plurality of through-holes in which the first conducting portion is positioned directly over the corresponding second conducting portion through the corresponding through-hole.

When the pressing member experiences an external pressure, the pressure is transferred through the fluid inside the cavity onto the translucent insulated layer. Consequently, the insulated layer pushes down on the first conductive layer which drives the first conducting portion to actuate down through the corresponding through-hole and makes electrical contact with the corresponding second conducting portion.

In summary, the instant disclosure of the resilient pressing member structure provides the end users' with a better and clearer display for pressing member functions under any environment with inadequate lighting. Secondly, the instant disclosure can replace the function of the detached large-ranged light guiding board and film for pressing member backlighting, thus significantly increases the product's backlight brightness, lower cost from extra parts, and hence increases the competitiveness of the product. Furthermore, the cavity of the pressing members is filled one of the following fluids: a gas or a liquid. The pressing members are in turn equipped with cushioning and pressure dissipating functionality, thus prevents end users from finger fatigue and increase comfort for prolong usage. Furthermore, the instant disclosure also offers noise reduction effect by reducing the sound generated during pressing member strokes.

DETAILED DESCRIPTION OF THE PREFERRED EMBODIMENTS

Figure 1:
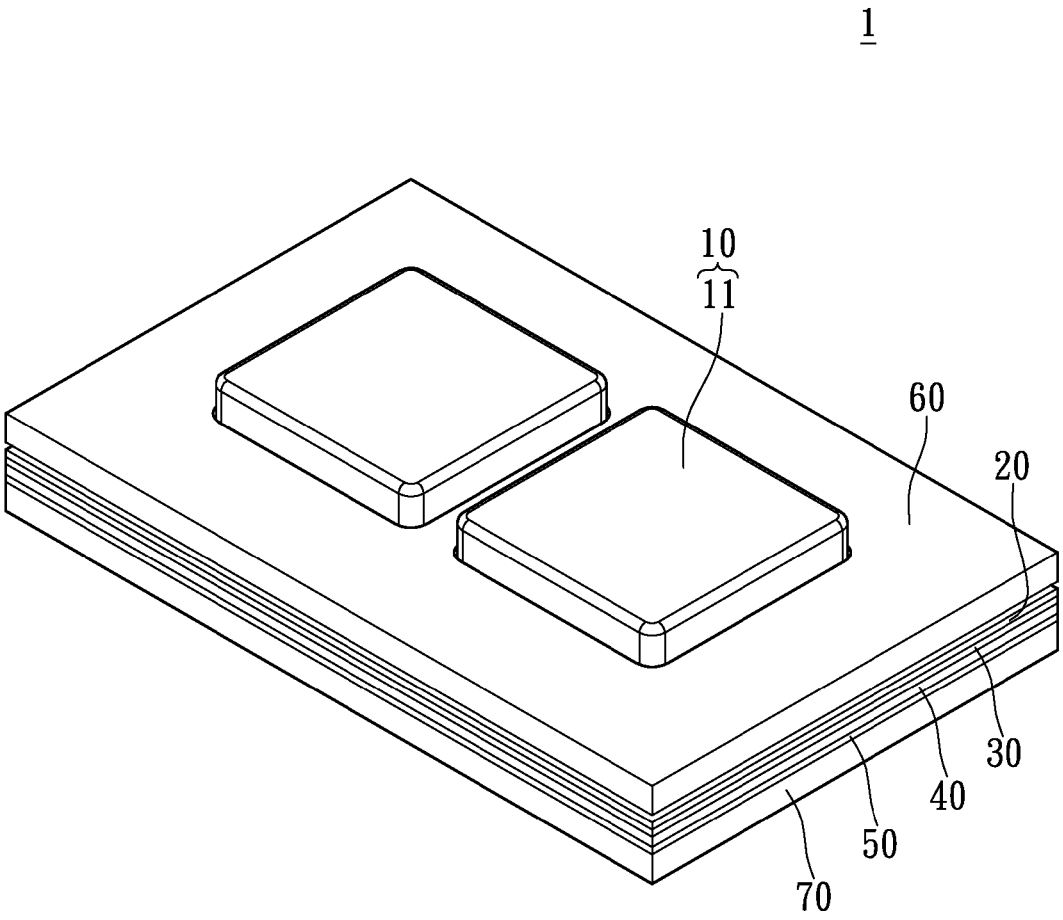
FIG. 1 shows an assembled schematic diagram of a resilient pressing member structure in accordance with a first embodiment of the instant disclosure.
Figure 2:
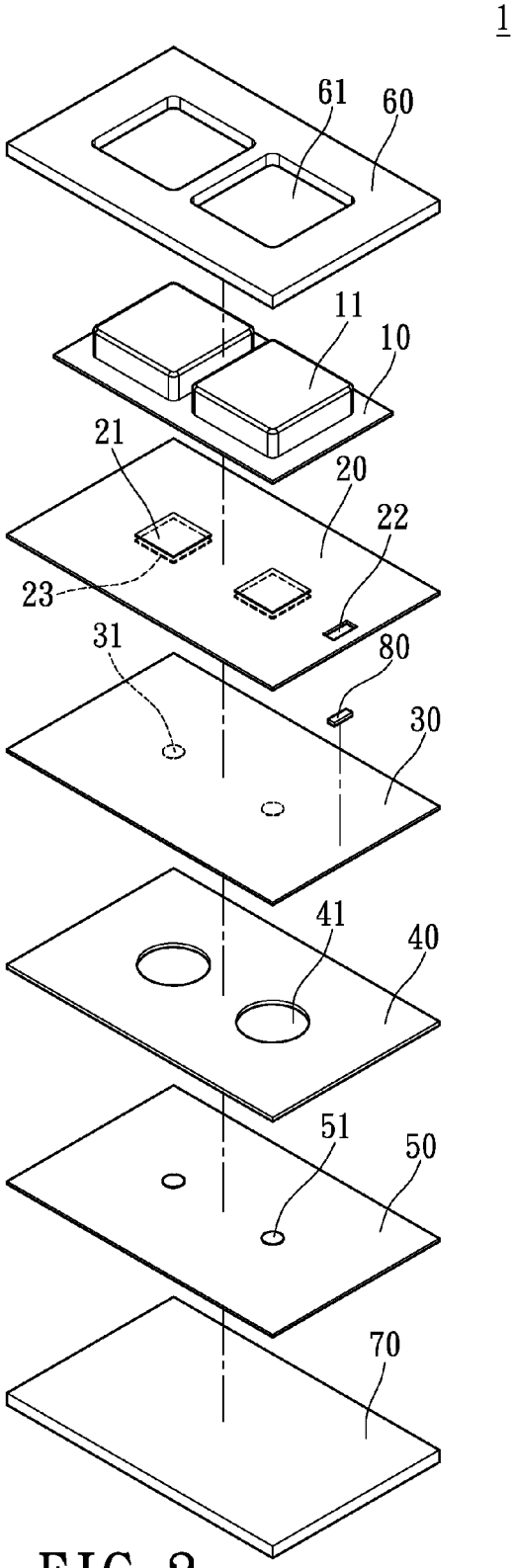
FIG. 2 shows an exploded diagram of a resilient pressing member structure in accordance with the embodiment of the instant disclosure.

FIG. 1 and FIG. 2 illustrate an isometric view and an exploded view of a resilient pressing member structure 1 in accordance with an embodiment of the instant disclosure. The resilient pressing member structure 1 in FIG. 1 comprised of a upper cover 60, a pressing unit 10, a translucent insulated layer 20 that comprises at least one light guiding structure 21 disposed on the topside thereof and a light reflecting structure 23 disposed on the bottom-side thereof in correspondence to the light guiding structure 21, a first conductive layer 30, a spacer 40, a second conductive layer 50, and may further include a base plate 70.

Figure 3:
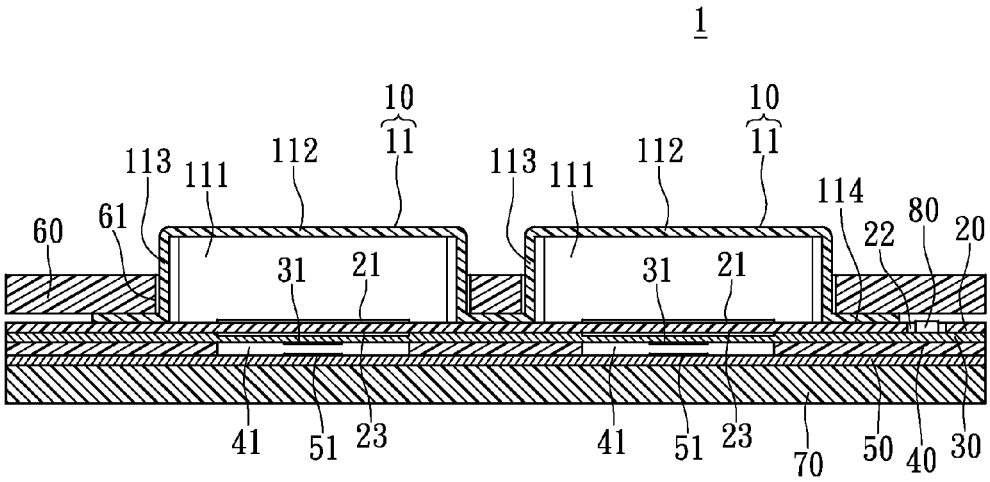
FIG. 3 shows a cross-sectional diagram of a resilient pressing member structure, where the light-emitting unit is disposed inside the light unit opening, in accordance with the embodiment of the instant disclosure.

FIG. 3 illustrates a cross-sectional view of the resilient structure 1. The pressing unit 10 is arranged on a top-side (i.e., the user-facing side) of the translucent insulated layer 20. The pressing unit 10 comprises a plurality of pressing members 11, which are integrally formed on the pressing unit 10 by suitable means including molding. Suitable materials for the pressing members 11 include but are not limited to plastic, silicone, resin, and other polymer materials that possess adequate flexibility/resilience. Each pressing member 11 comprises of a resilient contact surface 112 for receiving pressing manipulation from a user, a plurality of side faces 113, and a plurality of adjoining surfaces 114 that can be anchored in a proper position with respect to the rest of the backlight structure 1. The resilient contact surface 112 is essentially the top surface of the pressing member's 11 body which functions as the contact surface for receiving external forces. The resilient contact surface 112 is not limited to a flat curvature, but may have a concave, or a convex curvature. Symbols, numbers, and text can be integrated into the design of the resilient contact surface 112.

The side faces 113 extend downward from the resilient contact surface 112 (i.e. away from a user toward the bottom side of the pressing member structure 1). It is preferable for the side faces 113 to be materially and structurally arranged in such a way that offers sufficient restoring/resilient properties in response to an external stroke to the pressing member 11, e.g., being more rigid than the insulated layer 20 and the first conductive layer 30. Specifically, possible design feature to achieve the above requirement includes using harder materials for the side faces 113 in comparison with both the insulated layer 20 and the first conductive layer 30 to reduce deformation on the side faces 113 and/or by structurally increasing the thickness of the side faces 113. However, methods to reducing deformation are not only limited to the factors above. Extending from the lower ends of the side faces 113 forms the plurality of adjoining surfaces 114 configured to enable the establishment of sealing contact with the translucent insulated layer 20. Thereby, positioning the pressing members 11 over the top of the translucent insulated layer 20. Suitable materials for the translucent insulated layer 20 includes but not limited to Mylar, Polyethylene film, Polypropylene film, Polystyrene film and other polymer films/membranes.

The pressing member 11 is preferably of a hollow structure that defines a cavity 111. Specifically, the cavity is bounded by the pressing member's 11 resilient contact surface 112, the side faces 113, and is sealed off by the translucent insulated layer 20 on the bottom, thus constituting a fluid holding space. The cavity 111 may be filled with an appropriate amount gas or liquid to serve as a buffer and provide cushioning effect for the pressing member structure 1. The gas pertains to but is not limited to air, inert gas, and nitrogen gas, while the liquid pertains to but is not limited to water, oil, and polymer materials. When an external pressure is exerted on the resilient contact surface 112, the buffer within the pressing members 11 functions as a cushion and disperses pressure. Therefore, when the external pressure is exerted on the resilient contact surface 112, one of the two fluids within the cavity 111 will experience pressure as well. Through the buffer, pressure may be transferred downward (toward the conductive layers 30/50). Due to the material of the side face 113 is more rigid than the insulated layer 20 and the first conductive layer 30, the movement of one of the two fluids within the cavity 111 is directed generally in the downward direction. Thus, the majority of the external pressure is transferred vertically downwards onto the insulated layer 20, thus, causing the insulated layer 20 and the first conductive layer 30 to deform.

The upper cover 60 of the instant exemplary embodiment is disposed on top of the pressing unit 10. The upper cover 60 has a plurality of pressing member openings 61 arranged thereon which bounds the pressing members 11 yet allows the pressing members 11 to be exposed. Besides physical confinement, the interior walls of the pressing member opening 61 can exert an opposite force onto the side faces 113 of the pressing members 11. The opposite force may cause the deformation to occur at the lower ends of the pressing members 11, and in turn transfer external pressure to the insulated layer 20. In other words, the interior walls of the pressing member opening 61 may physically confine the pressing members 11 to deform downwards (into the conductive layers 30/50). Furthermore, the resilient pressing member structure 1 may include a base plate 70 attached to the backside of the second conductive layer 50 for providing structural support. By applying the upper cover 60 to the base plate 70, a case is formed to offer protection for internal structures.

The translucent insulated layer 20 has at least one light unit opening 22 to accommodate one or more light-emitting unit 80. However, the disposition of the light-emitting unit 80 is not limited to the abovementioned arrangement of being accommodated in the translucent insulated layer 20; the light-emitting unit 80 may alternatively be arranged in the first conductive layer 30, the spacer 40, or the second conductive layer 50. In other words, disposition of the light-emitting unit 80 is not particularly restricted as long as the light-emitting unit 80 is positioned underneath the pressing unit 10. The light-emitting unit 80 may be connected electrically to the first conductive layer 30, or may be connected through other electrical means to receive power. The light-emitting unit 80 can be light-emitting diode and/or other suitable light-emitting sources. The translucent insulated layer 20 is characterized by having a plurality of light guiding structures 21 disposed on a top surface thereof at positions correspondingly underneath the pressing members 11 and a plurality of light reflecting structures 23 disposed on the backside thereof in respective correspondence to the light guiding structures 21. In other words, both the light guiding structure 21 and the light reflecting structure 23 are arranged aligningly underneath the pressing members 11 to give optimal light guidance and increase light reflection. The light guiding structure 21 can be but is not limited to a light guiding film, a light guiding sheet, a light guiding plate, a light guiding bar, light guiding ink and other light guiding material. The light reflecting structure 23 can be but is not limited to a light reflective sheet, a light reflective mirror, and a light reflective coating.

Figure 4:
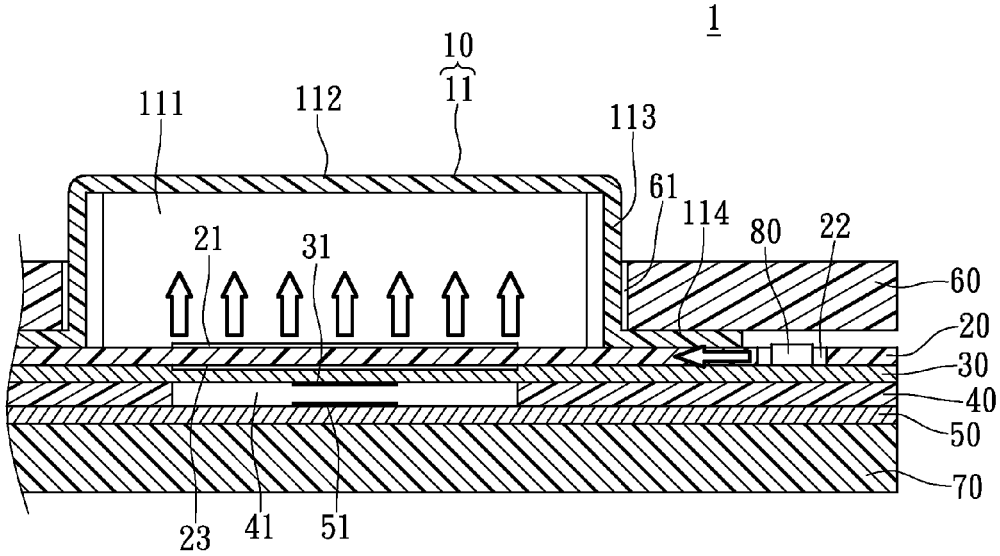
FIG. 4 shows a cross-sectional diagram of a resilient pressing member structure to depict the route of the light source in accordance with the embodiment of the instant disclosure.

Please refer to FIG. 4 When the light-emitting unit 80 illuminates, the emitted light traverses horizontally through the translucent insulated layer 20 (as indicated by the left-pointing arrow) and reaches the area underneath the pressing members 11. Meanwhile, the emitted light, which travels horizontally across the translucent insulated layer 20, is redirected vertically towards the center region of the pressing members 11 via the light guiding structure 21. For instance, when the light source reaches the area underneath the pressing members 11, the light guiding film (or the dotted-matrix arrangement formed by light guiding ink) redirects the direction of the light source vertically upwards. Consequently, the light source penetrates through the buffer in the cavity 111, then passes through the surface of the pressing members 11, and finally diffuses out of the pressing members 11. Furthermore, the light reflecting structure 23 which is disposed on the backside of the translucent insulated layer 20 reflect light more effectively to increase brightness, thus generating enhanced illumination effect.

The uniformity and intensity of the light output may be manipulated through varying the density of the light guiding structure 21 in order to achieve the desired illuminating effect, particularly, to enable higher visibility in environments of insufficient lighting condition that requires higher magnitude of brightness. Other factors that contribute to higher light output uniformity and intensity may include using pressing members 11 with larger surface area/longer length, or by increasing the density of the light guiding structure 21 at locations that require additional visibility. Besides density arrangement, the addition of light guiding materials into the composition of the pressing members' 11 (mixed therein during the pressing members' 11 manufacturing phase) also offers higher light guiding characteristics to the pressing members 11, thus allowing the pressing members 11 to diffuse light with higher uniformity.

Figure 5:
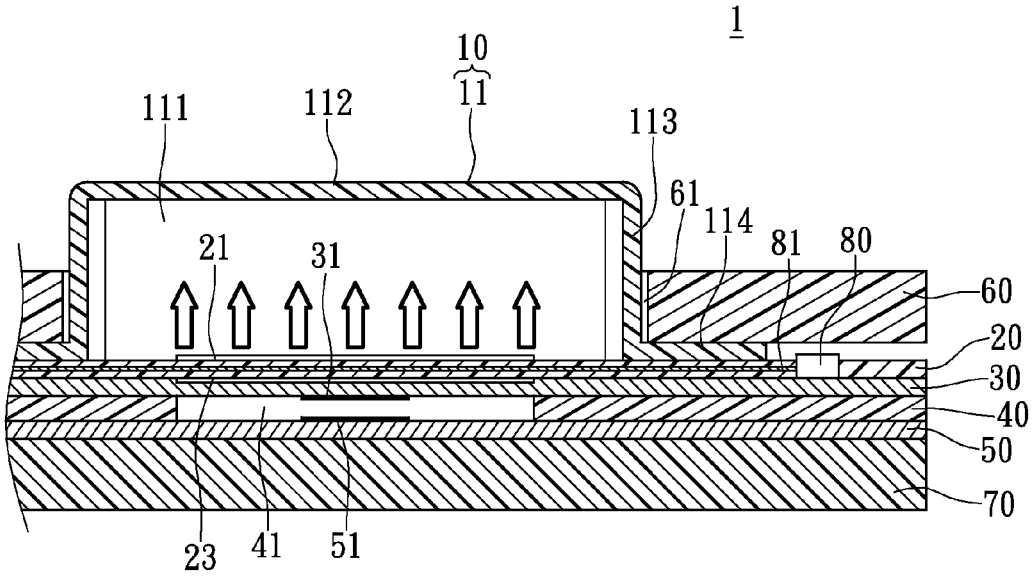
FIG. 5 shows a cross-sectional diagram of a resilient pressing member structure to illustrate the connectivity between the light-emitting unit and the conductive structure in accordance with the embodiment of the instant disclosure.
Figure 6:
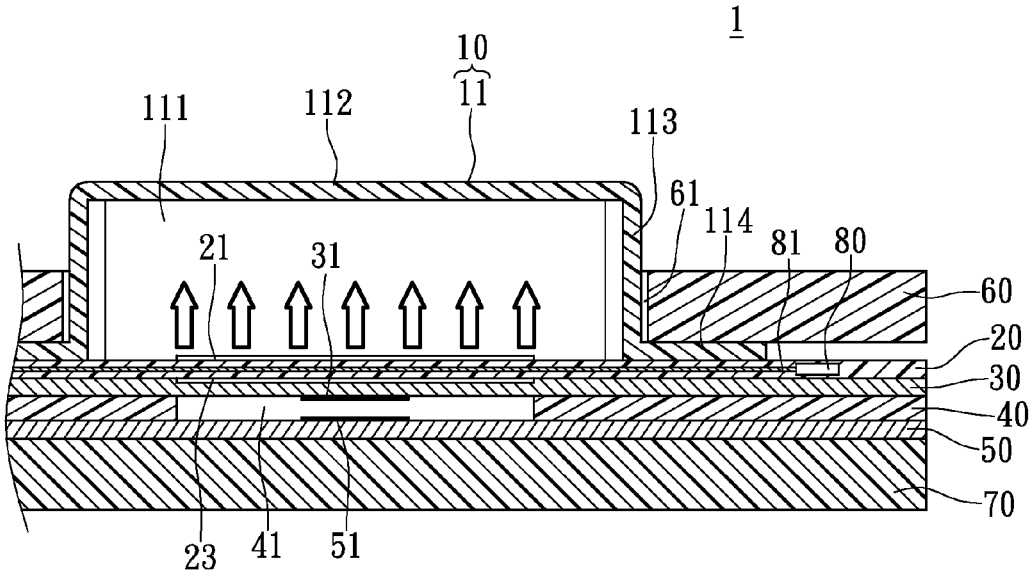
FIG. 6 shows a cross-sectional diagram of a resilient pressing member structure, where the light-emitting unit is disposed on top of the translucent insulated layer, in accordance with the embodiment of the instant disclosure.
Figure 7:
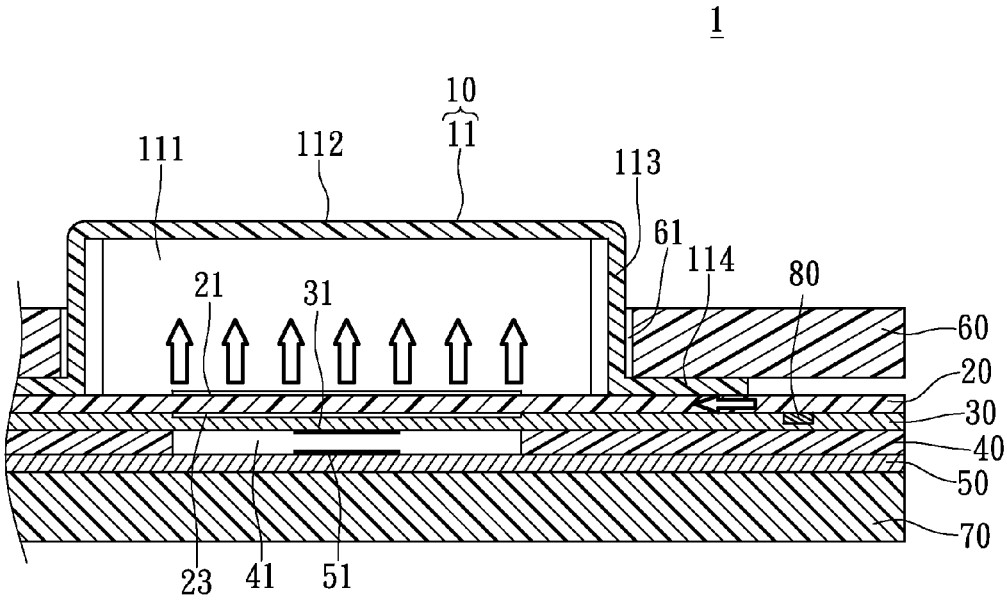
FIG. 7 shows a cross-sectional diagram of a resilient pressing member structure, where the light-emitting unit is embedded inside the first conductive layer, in accordance with the embodiment of the instant disclosure.

In an alternative embodiment such as shown by FIG. 5, the light-emitting unit 80 is connected to a conductive structure 81. The materials for the conductive structure 81 can be but are not limited to either one of the following: flexible printed circuit board, conductive wiring, and other materials, as long as the design allows the light-emitting unit 80 to constitute an independent circuit. In FIG. 6, the light-emitting unit 80 is arranged inside the translucent insulated layer 20, and as a result becomes an independent circuit which is not electronically connected to the first conductive layer 30. FIG. 7 demonstrates another disposition of the light-emitting unit 80, where the light-emitting unit 80 is disposed in the first conductive layer 30 with an open surface for transferring light through the translucent insulated layer 20. By means of the open surface on the light-emitting unit 80, light can travel horizontally through the translucent insulated layer 20, and subsequently, vertically through the light guiding structure 21, and finally diffuses through the pressing members 11.

Referring back to FIG. 3 are further details on the mechanics of the first conductive layer 30. The first conductive layer 30 can be and is not limited to one of the following types of mediums: thin-film circuit board, flexible circuit board, printed circuit board and other apparatus with the capability of conducting electrical signal. In the instant embodiment, the first conductive layer 30 uses film-type circuit board with a plurality of first conducting portions 31. Each first conducting portion 31 is individually disposed onto the backside of the first conductive layer 30, and is directly positioned beneath each pressing member 11. First conducting portion 31 may have electrical conductivity characteristics of a conductor such as but is not limited to metal, graphite, and conductive polymer materials.

Second conductive layer 50 is disposed below the first conductive layer 30. Similar to the first conductive layer 30, the second conductive layer 50 can be but is not limited to one of the following types of mediums: thin-film circuit board, flexible circuit board, printed circuit board and other apparatus with the capability of conducting electrical signal. In the instant embodiment, the second conductive layer 50 uses film-type circuit board with a plurality of second conducting portions 51. Each second conducting portion 51 is individually disposed on the topside of the second conductive layer 50, and is directly positioned beneath first conducting portion 31. The second conducting portions 51 may possess electrical conductivity characteristics of a conductor such as but not limited to metal, graphite, and conductive polymer materials.

In this exemplary embodiment, the spacer 40 is sandwiched between the first conductive layer 30 and the second conductive layer 50. Material of the spacer 40 can be but is not limited to plastic, silicon, resin, and other polymer materials. The spacer 40 has a plurality of through-holes 41 which are directly positioned beneath the light guiding structure 21, and the light reflecting structure 23. Thus, allowing the first conducting portion 31 and the second conducting portion 51 to directly face each other. Furthermore, the through-holes 41 become the channels in which actuation of the first conducting portion 31 occurs, hence providing the means for the first conducting portion 31 to make electrical contact with the second conducting portion 51.

Figure 8:
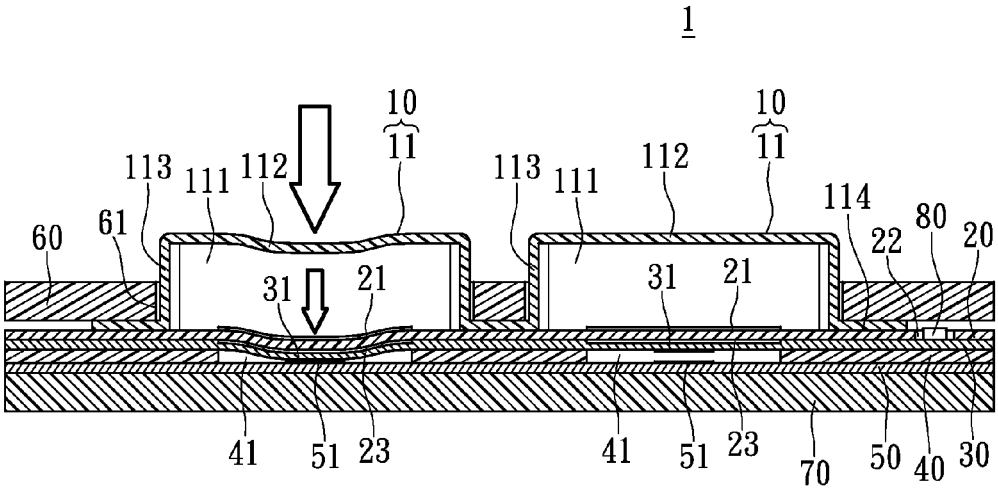
FIG. 8 shows a cross-sectional diagram of a resilient pressing member structure, where an external force is exerted onto the resilient contact surface of the pressing members, in accordance with the embodiment of the instant disclosure.

Please refer to FIG. 8, which depicts a transverse cross-sectional view of a pressing member structure 1 in accordance with the instant disclosure under external pressure. When under external pressure (such as being pressed by a human user), the pressing member 11 transfers the pressing force to the first conductive layer 30 and cause deformation thereof, thereby establishing electrical contact between the first conducting portion 31 and second conducting portion 51. The downward manipulation of the pressing member 11 by external force (as indicated by the downward-pointing arrow) has been discussed in detail in prior sections of this disclosure, and therefore will not be repeated.

To summarize, when the resilient contact surface 112 on the pressing members 11 experience an external force, the external force is transferred through the fluid buffer in the cavity 111 of the pressing members 11. Since the side faces' 113 material are more rigid than the insulated layer 20 and the first conductive layer 30, and the pressing member opening 61 exerts physical constraint on lateral expansion of the pressing members 11, thus the external force is generally directed downward. Consequently, the deflected external force is translated into pressure which is then transferred down towards the translucent insulated layer 20. Under pressure, the translucent insulated layer 20 deforms. As a result, pressure is transmitted onto the first conductive layer 30 which actuates downwards. Simply by contacting with the first conductive layer 30, the first conducting portion 31 actuates downwards into the through-holes 41 and makes electrical contact with the second conducting portion 51. Thus establishing electrical signals between the first conductive layer 30 and second conductive layer 50 in which both are already connected to circuit layouts. When an end user desires to input a signal, the end user may choose to strike the resilient contact surface 112 downwards and thus generating a downward pressure force. One of the two fluids: gas and liquid which is inside the cavity 111 then experiences the downward force and in turn pushes the translucent insulated layer 20 downwards. Consequently, the downward pressure carries through to the first conductive layer 30 and causes deformation not only in the first conductive layer 30, but also in the first conducting portion 31 which subsequently makes contact with the second conducting portion 51 to achieve signal conductance. As a result, through electric conductance, the end user's input can be transformed into signals out to any electronic peripherals which are connected to the resilient pressing member structure 1.

The instant disclosure of resilient pressing member structure 1 can be integrated with desktop keyboard, laptop keyboard, electronic dictionary keyboard, e-book keyboard, home phone keypad, mobile phone keypad, radio keypad, remote control keypad, and other types of functional keyboard which presents the end user with excellent and bright display in environments with insufficient lighting. The resilient pressing member structure 1 can have more than one pressing member 11. The resilient pressing member structure 1 may take one of the following physical forms: square, rectangle, rhombus, polygon, circles, and other shapes, to meet users' demand. In addition, the resilient pressing member structure 1 serves as a general key type interface for any electronics which may require keys.

In summary, the instant disclosure not only increases the end user experience, but also reduces cost and environmental impact. For instance: since light is generated through the light-emitting unit 80, penetrates through the translucent insulated layer 20, and reaches the light guiding structure 21 which guides the light onto the pressing members 11 for illumination. As a result, end users' received a better and clearer display for key functions under environments with inadequate lighting.

Secondly, because the pressing members 11 are filled with one of the following fluids: gas or liquid, the pressing members 11 are equipped with cushioning and pressure dissipating functionalities. Thus, preventing end users from finger fatigue and increasing comfort for prolong usage. Furthermore, the instant enclosure's design offers noise reduction effect by reducing the sound generated during keystrokes.

Furthermore, the instant disclosure of resilient pressing member structure 1 may replace the function of the detached large-ranged light guiding board and film, while amplifying the product's backlight brightness which reduce cost from extra parts, and hence increase the competitiveness of the product Finally, the height of the resilient pressing member structure 1 has been significantly reduced from the original product to not only cut down in weight which decreases the amount of materials, but also to benefit the environment and improve portability. Moreover, the pressing unit 10 is disposed on top of the translucent insulated layer 20 making contact with the first conductive layer 30 below the insulated layer 20. When abnormalities occur on the pressing members 11 during manufacturing, only the pressing unit 10 is necessary for replacement which increases product yield. In other words, replacements for signal circuit-related equipment are not necessary and cost advantages are attained.

The descriptions illustrated supra set forth simply the preferred embodiments of the present invention; however, the characteristics of the present invention are by no means restricted thereto. All changes, alternations, modifications conveniently considered by those skilled in the art are deemed to be encompassed within the scope of the present invention delineated by the following claims.

What is claimed is:

1. A resilient pressing member structure comprising:

a translucent insulated layer;

a pressing unit disposed on the topside of the translucent insulated layer comprising a plurality of pressing members, each pressing member including a resilient contact surface for receiving external load and a plurality of side faces extending downward from the resilient contact surface, wherein the translucent insulated layer and the pressing unit establish sealing contact so as to cooperatively define a plurality of fluid-holding cavities;

a upper cover disposed on the pressing unit having a plurality of pressing member openings configured to allow exposure of the pressing members therefrom and confining the side faces of each of the pressing members;

a first conductive layer disposed underneath the backside of the translucent insulated layer including a plurality of first conducting portions respectively arranged on a bottom surface thereof in correspondence to the position of the pressing members;

at least one light emitting unit disposed below the pressing unit;

a second conductive layer positioned underneath the first conductive layer including a plurality of second conducting portions respectively arranged on a top surface thereof in correspondence to the first conducting portion; and a spacer arranged between the first conductive layer and the second conductive layer and including a plurality of through-holes defined thereon through which each of the first conducting portions directly faces each of the second conducting portion, the side faces being more rigid than the insulated layer and the first conductive layer.

2. The resilient pressing member structure according to claim 1, wherein the translucent insulated layer is formed with at least one light unit opening disposed therein.

3. The resilient pressing member structure according to claim 1, wherein the light-emitting unit is arranged in the translucent insulated layer.

4. The resilient pressing member structure according to claim 1, wherein the light-emitting unit is electronically connected to the first conductive layer.

5. The resilient pressing member structure according to claim 1, wherein the light-emitting unit is electronically connected to a conductive structure.

6. The resilient pressing member structure according to claim 1, wherein the light-emitting unit is a light-emitting diode.

7. The resilient pressing member structure according to claim 1, wherein light guiding materials are added into material composition of the pressing members.

8. The resilient pressing member structure according to claim 1, wherein the pressing members initiate the contact between the bottom of the first conducting portion and the top of the second conducting portion to establish electrical connectivity between the first conducting portion, and the second conducting portion.

9. The resilient pressing member structure according to claim 1, wherein includes a base plate attached on the backside of the second conductive layer.

10. The resilient pressing member structure according to claim 9, wherein the upper cover in combination with the base plate form a case to provide protection for internal structures.

11. The resilient pressing member structure according to claim 1, wherein at least one light guiding structure is disposed on the topside of the translucent insulated layer corresponding to each pressing member.

12. The resilient pressing member structure according to claim 11 wherein the light guiding structure is formed with one of the following materials: a light guiding film, a light guiding sheet, a light guiding plate, a light guiding bar, light guiding ink and other light guiding material.

13. The resilient pressing member structure according to claim 11 wherein at least one light reflecting structure is disposed on the backside of the translucent insulated layer corresponding to each pressing member.

14. The resilient pressing member structure according to claim 13 wherein the light reflecting structure is formed with one of the following materials: a light reflective sheet, a light reflective mirror, and a light reflective coating.

15. The resilient pressing member structure according to claim 13 wherein the light generated from the light-emitting unit penetrates through the translucent insulated layer, guides towards the pressing members by the light guiding structure, and is reflected and amplified by the light reflecting structure.

* * * * *